US006273030B1

(12) United States Patent
Harth, III

(10) Patent No.: US 6,273,030 B1
(45) Date of Patent: Aug. 14, 2001

(54) SPACER BAR WITH TUBE SLEEVE AND TAB

(75) Inventor: George H. Harth, III, Wadsworth, OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 09/680,725

(22) Filed: Oct. 6, 2000

(51) Int. Cl.[7] ..... F22B 37/20; F22B 37/24
(52) U.S. Cl. ..... 122/511; 110/325
(58) Field of Search ..... 122/510, 511; 110/325; 285/189, 190, 213; 138/128, 156, 158, 171

(56) References Cited

U.S. PATENT DOCUMENTS 4,030,540 * 6/1977 Roma ..... 122/510
4,480,594 * 11/1984 Sullivan et al. ..... 122/510
5,136,985 * 8/1992 Krowech ..... 122/511
5,404,941 * 4/1995 Jacksits ..... 122/510

* cited by examiner

*Primary Examiner*—Gregory Wilson
(74) *Attorney, Agent, or Firm*—Eric Marich

(57) ABSTRACT

A spacing arrangement for tubes of a reheater or superheater tube section uses a spacer bar that is sufficiently long to span a space across a plurality of tubes in the tube section. The spacer bar has a plurality of holes therein which are spaced apart by a selected spacing corresponding to a desired spacing between the plurality of tubes in the section. A plurality of sleeves is provided with one sleeve on adjacent tubes in the section. A tab is fixed to each sleeve and extends outwardly from the sleeve to which it is fixed so that the tabs of all the sleeves extend outwardly from a common plane containing all the adjacent tubes in the section. The tabs extend into respective holes in the spacer bar and fillet welds fix the tabs to the spacer bar adjacent the holes and at a location spaced from the sleeves.

11 Claims, 2 Drawing Sheets

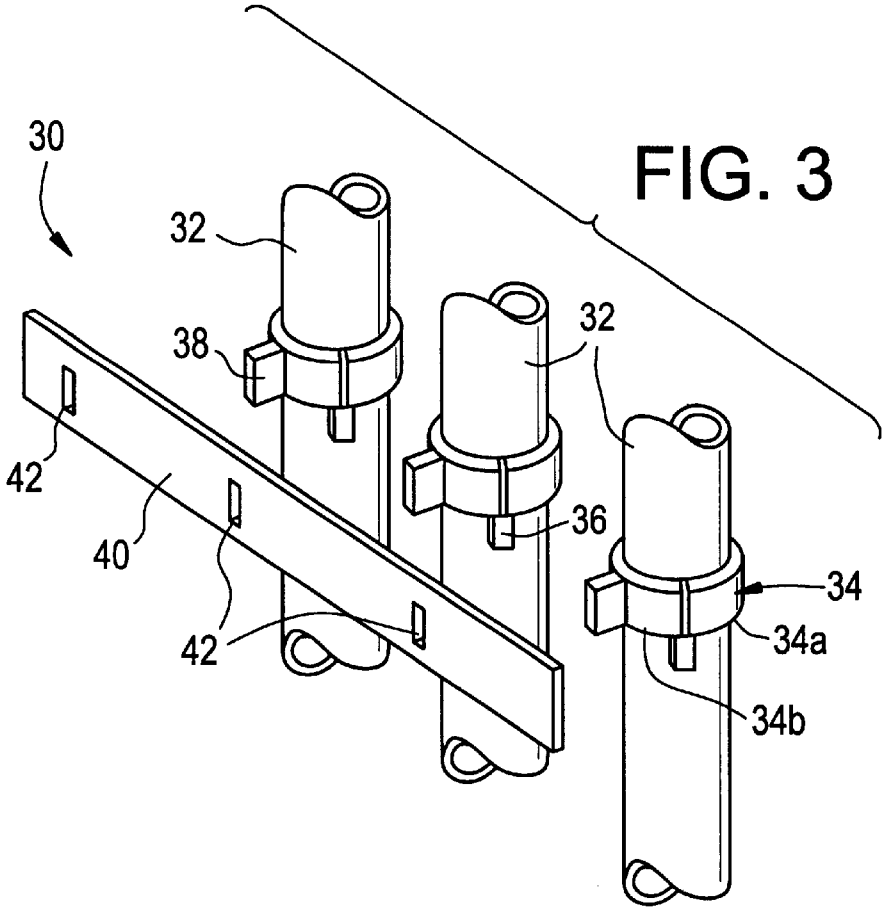
FIG. 3
FIG. 4
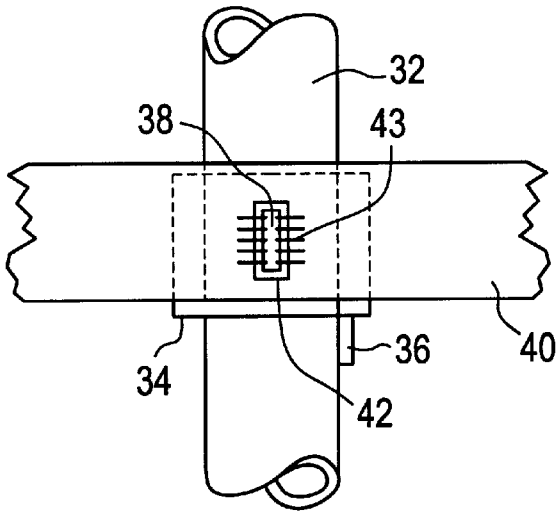
FIG. 5
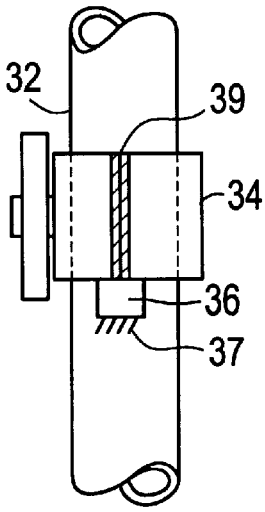

SPACER BAR WITH TUBE SLEEVE AND TAB

FIELD AND BACKGROUND OF THE INVENTION

The present invention relates in general to boilers and, in particular, to a new and useful arrangement for fixing the spacing between tubes in a superheater or reheater section or in other parts of a boiler where the tubes extend through the volume of the boiler.

Superheater and reheater sections of boilers have side-to-side ties to maintain spacing. As illustrated in FIG. 1, there have been several designs that utilize a metal bar 10, strung between the superheater or reheater tubes 12 of each section. The means by which the metal bar 10 has been attached to the tubes 12 has varied, but usually involves a strap 14 as illustrated in FIG. 1 around the tube 12 or a lug 16 as illustrated in FIG. 2 welded to the tubes 12. These attachments to the tubes 12 require welding behind the spacer bar 18 shown in FIG. 2, which is difficult. The lugs 16 sit in grooves at the bottom of bar 18 and are held in the grooves by retainers 20.

SUMMARY OF THE INVENTION

According to the present invention, a cast sleeve with an integral tab is slipped on the boiler tubes during shop section fabrication. For field installation, the casting is in two halves. A lug is welded to the tube to support the casting. During field erection of the sections, a spacer bar with properly located rectangular holes is positioned horizontally between (in the front or the rear) of the sections. The tabs are inserted into the holes in the spacer bar. Fillet welds attach the bar to the tab. This allows welding from the front. The new spacer bar with tube sleeve and tab is more readily installed. More importantly, the location of the bar to tab weld allows easy access to uncouple the sections for field maintenance access to the sections.

Accordingly, one aspect of the present invention is drawn to a spacing arrangement for tubes of a boiler which comprises a spacer bar that is sufficiently long to span a space across a plurality of tubes in a superheater or reheater section. The bar has a plurality of holes therein which are spaced apart by a selected spacing corresponding to a desired spacing between the plurality of tubes in the section. A plurality of sleeves is provided with one sleeve fixed to each tube in the section. A tab is fixed to each sleeve and extends outwardly from the sleeve to which it is fixed so that the tabs of all the sleeves extend outwardly from a common plane containing all the tubes in section. The tabs extend into respective holes in the spacer bar and fillet welds are used for fixing the tabs to the spacer bar adjacent the holes and at a location spaced from the sleeves.

An advantage of the present invention is that it provides a spacing arrangement for superheater and reheater tube banks which is simple in design, rugged in construction and economical to manufacture.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which a preferred embodiment of the invention is illustrated.

BRIEF DESCRIPTION OF THE DRAWINGS

In the drawings:

FIG. 3 is an exploded perspective view of the arrangement of the present invention;

FIG. 4 is a front elevational view of a tube connected to the arrangement of the present invention; and FIG. 5 is a side elevational view of the structure shown in FIG. 4.

DESCRIPTION OF THE PREFERRED EMBODIMENT

Figure 1:
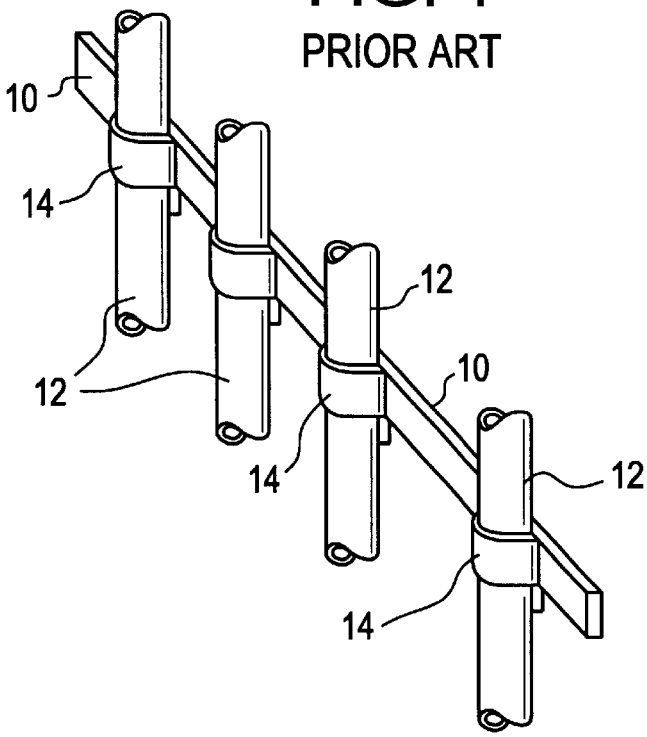
FIG. 1 PRIOR ART
FIG. 1 is a schematic perspective view of one prior art arrangement for spacing tubes in a superheater or reheater section of a boiler.
Figure 2:
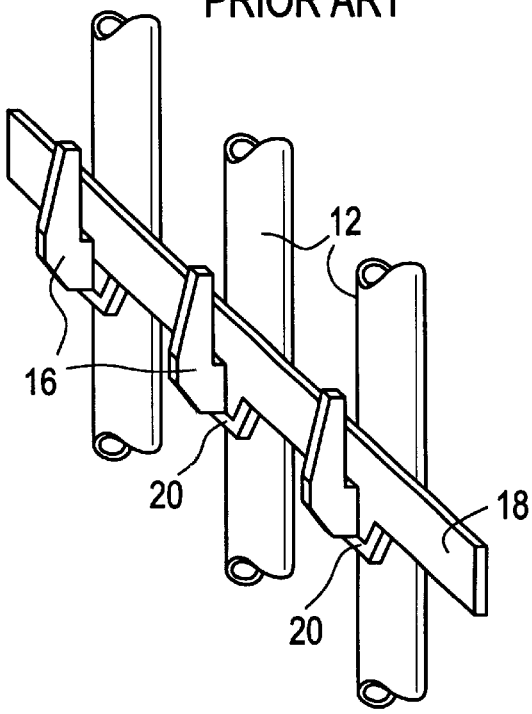
FIG. 2 PRIOR ART
FIG. 2 is a view similar to FIG. 1 of another prior art arrangement for spacing such tubes.

Referring to the drawings generally, wherein like reference numerals designate the same or functionally similar elements throughout the several drawings, FIGS. 3–5 illustrate the spacing arrangement 30 of the present invention for spacing tubes 32 of a superheater or reheater tube section. The arrangement 30 includes a spacer bar 40 that is sufficiently long to span the space across a plurality of tubes 32 that lie in a common plane in the tube section. The bar 40 has a plurality of rectangular holes 42 therein which are spaced apart by a selected spacing corresponding to a desired spacing between the tubes 32 in the tube section.

A plurality of sleeves 34 is provided with one sleeve fixed to each tube 32 in the tube section, for example in the fabrication shop. Each sleeve 34 rests on a lug 36 welded to each tube 32 at 37 and sets the position of the sleeve 34 on its tube 22.

A tab 38 is fixed, e.g. by welding, to each sleeve 34 and extends outwardly from the sleeve 34 to which it is fixed so that the tabs 38 of all the sleeves 34 extend outwardly from the common plane containing all the tubes 32 in the tube section. The tabs 38 extend into respective holes 42 in the spacer bar 40 and fillet welds 43 are used for fixing the tabs 38 to the spacer bar 40 adjacent the holes 42 and at a location spaced from the sleeves 34; that is, at an easily accessible location in front of the tubes 32.

For field assembly the sleeves 34 are each first provided in two halves 34*a* and 34*b*, and are welded to each other around each tube at 39, at the boiler site.

While a specific embodiment of the invention has been shown and described in detail to illustrate the application of the principles of the invention, it will be understood that the invention may be embodied otherwise without departing from such principles.

I claim:

1. A spacing arrangement for tubes of a tube section, comprising:

a spacer bar that is sufficiently long to span a space across a plurality of tubes in the tube section, the bar having a plurality of holes therein which are spaced apart by a selected spacing corresponding to a desired spacing between the plurality of tubes in the tube section;

a plurality of sleeves with one sleeve fixed to each tube in the tube section;

a tab fixed to each sleeve and extending outwardly from the sleeve to which it is fixed so that the tabs of all the sleeves extend outwardly from a common plane containing all the tubes in the tube section, the tabs extending into respective holes in the spacer bar; and means for fixing the tabs to the spacer bar adjacent the holes and at a location spaced from the sleeves.

2. The arrangement according to claim 1, wherein the holes are each rectangular.

3. The arrangement according to claim 1, wherein the tabs are connected to the spacer bar adjacent the holes by fillet welds.

4. The arrangement according to claim 1, wherein each sleeve comprises a pair of sleeve halves which are fixed to each other.

5. The arrangement according to claim 4, wherein the sleeve halves are welded to each other.

6. The arrangement according to claim 1, including a lug fixed to each tube for supporting a sleeve on each tube.

7. A method for spacing tubes of a tube section, comprising:

providing a spacer bar that is sufficiently long to span a space across a plurality of tubes in the tube section, the spacer bar having a plurality of holes therein which are spaced apart by a selected spacing corresponding to a desired spacing between the plurality of tubes in the tube section;

providing a plurality of sleeves on the tubes;

fixing a tab to each sleeve, each tab extending outwardly from the sleeve to which it is fixed so that the tabs of all the sleeves extend outwardly from a common plane containing all the tubes in the tube section;

engaging the spacer bar to the tubes by causing the tabs to extend into respective holes in the spacer bar; and fixing the tabs to the spacer bar adjacent the holes and at a location spaced from the sleeves.

8. The method according to claim 7, including fixing the tabs to the spacer bar using fillet welds.

9. The method according to claim 7, wherein each sleeve is a single part engaged to its respective tube at a fabrication shop.

10. The method according to claim 7, wherein each sleeve comprises a pair of sleeve halves, the method including connecting the pair of sleeve halves to each other to form each sleeve.

11. The method according to claim 7, including fixing a lug to each tube and resting the sleeve of each tube on the lug.

* * * * *